US007228981B2

(12) United States Patent
Chisholm

(10) Patent No.: US 7,228,981 B2
(45) Date of Patent: Jun. 12, 2007

(54) BLOW-MOLDED HOURGLASS CONTAINER WITH HELICAL RIB AND METHOD OF MANUFACTURE

(75) Inventor: Brian J. Chisholm, Toledo, OH (US)

(73) Assignee: Graham Packaging Company, LP, York, PA (US)

( * ) Notice: Subject to any disclaimer, the term of this patent is extended or adjusted under 35 U.S.C. 154(b) by 145 days.

(21) Appl. No.: 10/993,367

(22) Filed: Nov. 22, 2004

(65) Prior Publication Data

US 2006/0108318 A1 May 25, 2006

(51) Int. Cl.
*B65D 1/02* (2006.01)
*B65D 1/42* (2006.01)
*B29C 49/00* (2006.01)

(52) U.S. Cl. ..... 215/382; 215/379; 215/384; 220/669; 220/675; 264/523

(58) Field of Classification Search ..... 215/379, 215/382, 384, 900, 381, 383; 220/666, 669, 220/671, 675, 771; 264/523
See application file for complete search history.

(56) References Cited

U.S. PATENT DOCUMENTS

| | | | | |
|---|---|---|---|---|
| 15,593 | A | 8/1856 | Stickney | |
| D64,152 | S | 3/1924 | Sweeney | |
| D76,354 | S | 9/1928 | Reid | |
| D153,194 | S | 3/1949 | Wiedhopf | |
| D155,868 | S | 11/1949 | Braun | |
| D185,296 | S | 5/1959 | Mas | |
| 2,886,084 | A * | 5/1959 | Davison | 220/666 |
| D187,302 | S | 2/1960 | Campbell | |
| D195,063 | S | 4/1963 | Lilling | |
| 3,185,353 | A * | 5/1965 | Mercier | 222/206 |
| D209,931 | S | 1/1968 | Sterges | |
| D212,276 | S | 9/1968 | Lodding | |
| D214,158 | S | 5/1969 | Pettengill | |
| 3,536,500 | A * | 10/1970 | Cleereman et al. | 426/130 |
| D222,336 | S | 10/1971 | Leary | |
| 3,946,903 | A * | 3/1976 | Parker | 222/92 |
| D250,574 | S * | 12/1978 | Boyle | D9/537 |
| D286,617 | S | 11/1986 | Goodwin et al. | |
| D314,136 | S | 1/1991 | Malvoisin | |
| D319,183 | S * | 8/1991 | Halm | D9/552 |
| 5,209,372 | A * | 5/1993 | Norwood | 220/666 |
| 5,370,250 | A * | 12/1994 | Gilbert | 222/1 |
| 5,584,413 | A * | 12/1996 | Jung | 220/666 |
| D386,401 | S * | 11/1997 | Prestia et al. | D9/552 |
| 5,704,504 | A | 1/1998 | Bueno | |
| 5,774,773 | A * | 6/1998 | Otsuka et al. | 399/262 |
| D403,244 | S * | 12/1998 | Van Dyk et al. | D9/552 |

(Continued)

*Primary Examiner*—Sue A. Weaver
(74) *Attorney, Agent, or Firm*—Venable LLP; Caroline J. Swindell; Steven J. Schwarz

(57) ABSTRACT

A plastic container includes a body of one-piece integrally blow-molded construction. The body has an hourglass shape in side elevation with a waist, a base and a shoulder, and at least one helical external rib extending at least one full turn around the waist. The hourglass shape provides as a result of the blow molding operation minimum hoop stretch and extra thickness and strength at the waist, and maximum hoop stretch and minimum thickness at the shoulder and base. The helical rib at the waist of the container gives mechanical stiffness and resiliency for gripping and squeezing the container at the waist, yet allows angular movement of the shoulder with respect to the base to enhance flexibility.

17 Claims, 3 Drawing Sheets

U.S. PATENT DOCUMENTS 5,848,516 A * 12/1998 Ban ..... 53/453
5,908,127 A * 6/1999 Weick et al. ..... 215/373
5,935,505 A 8/1999 Whetten et al.
D420,588 S 2/2000 Fitelson et al.
D430,493 S 9/2000 Weick
6,112,925 A * 9/2000 Nahill et al. ..... 215/382
6,134,411 A * 10/2000 Meyer et al. ..... 399/262
6,137,972 A * 10/2000 Playfair et al. ..... 399/106
6,145,681 A * 11/2000 Chimetto et al. ..... 215/384
D434,668 S 12/2000 Chimetto et al.
6,289,195 B1 * 9/2001 Ichikawa et al. ..... 399/262
6,298,208 B1 * 10/2001 Kawamura et al. ..... 399/262
6,304,739 B1 * 10/2001 Katsuyama et al. ..... 399/262
D450,590 S * 11/2001 Van Dyk et al. ..... D9/502
6,424,812 B1 * 7/2002 Hsu ..... 399/262
6,472,007 B2 * 10/2002 Bezek et al. ..... 426/115
D479,131 S 9/2003 Warner et al.
6,662,964 B2 * 12/2003 Higuchi ..... 220/667
6,669,040 B2 * 12/2003 Higuchi ..... 215/381
6,701,112 B2 * 3/2004 Kusano et al. ..... 399/262
2002/0008077 A1 1/2002 Lane et al.
2002/0106215 A1 * 8/2002 Ban et al. ..... 399/120
2004/0069740 A1 * 4/2004 Athalye ..... 215/381

* cited by examiner

BLOW-MOLDED HOURGLASS CONTAINER WITH HELICAL RIB AND METHOD OF MANUFACTURE

The present invention relates to blow-molded plastic containers, and more particularly to a container that is specifically designed to be lightweight in construction.

SUMMARY OF THE INVENTION

A plastic container in accordance with one aspect of the present invention includes a body of one-piece integrally blow-molded construction. The body has an hourglass shape in side elevation with a waist, a base and a shoulder, and at least one helical external rib extending at least one full turn around the waist. The hourglass shape provides as a result of the blow molding operation minimum hoop stretch and extra thickness and strength at the waist, and maximum hoop stretch and minimum thickness at the shoulder and base. The helical rib at the waist of the container gives mechanical stiffness and resiliency for gripping and squeezing the container at the waist, yet allows angular movement of the shoulder with respect to the base to enhance flexibility. In the preferred embodiments of the invention, the container can be of polypropylene (PP) extrusion blow-molded construction or polyethylene terephthalate (PET) reheat blow-molded construction.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

Figure 3:
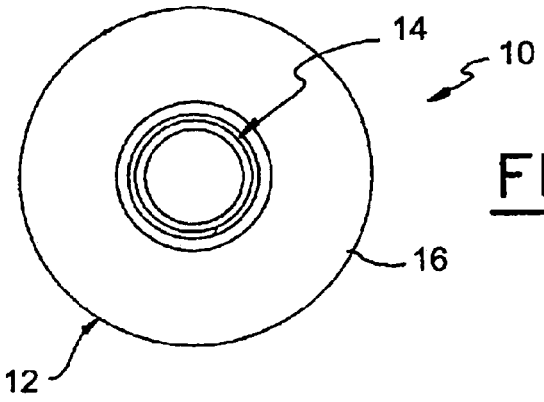
FIG. 3 is a top plan view of the container in FIGS. 1 and 2.
Figure 1:
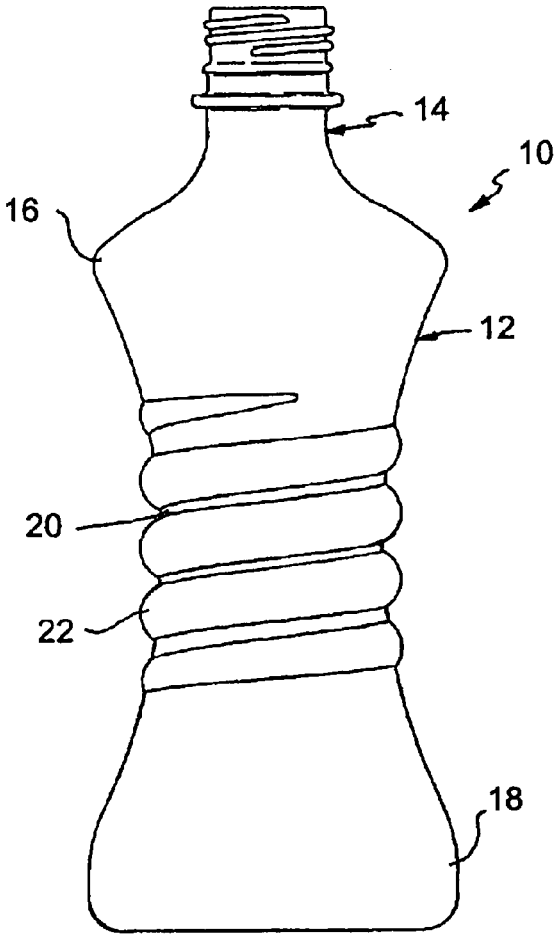
FIG. 1 is a front elevational view of a container in accordance with one presently preferred embodiment of the invention.
Figure 2:
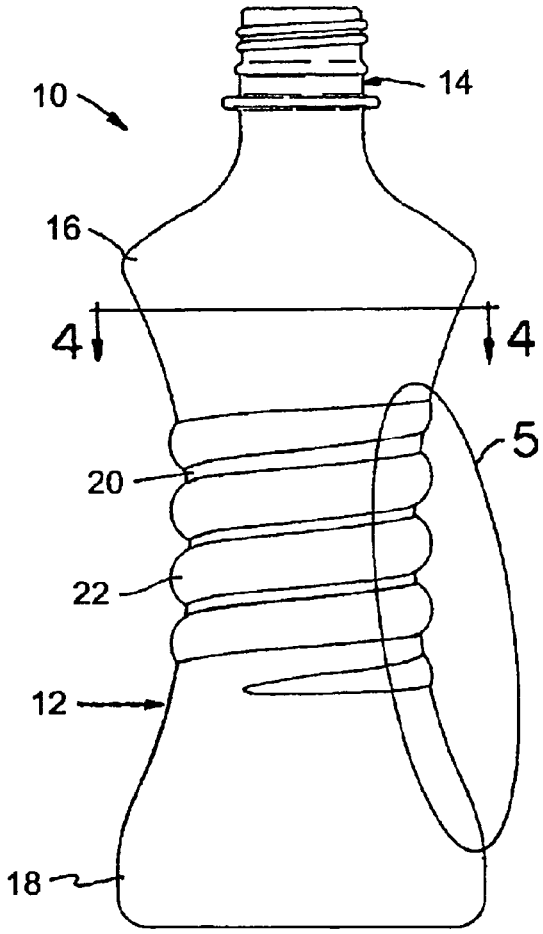
FIG. 2 is a rear elevational view of the container in FIG. 1.
Figure 4:
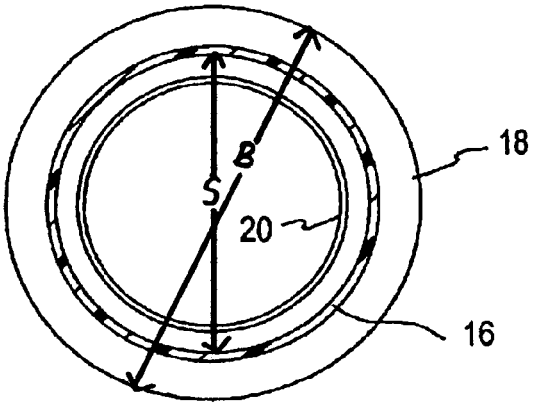
FIG. 4 is a sectional view taken substantially along the line 4—4 in FIG. 2.

The drawings illustrate a container 10 of integrally blow-molded plastic construction in accordance with one presently preferred embodiment of the invention. The container 10 includes a body 12 from which a neck finish 14 integrally extends. Container body 12 is of hourglass-shaped configuration, having a shoulder 16 and a base 18 interconnected by a waist 20. Shoulder 16, base 18 and waist 20 are all of circular geometry in plan view, as best seen in FIGS. 3 and 4, and preferably are coaxial with each other and with neck finish 14. Neck finish 14 may be of any desired construction, with the construction of FIGS. 1 and 2 being exemplary only.

Figure 5:
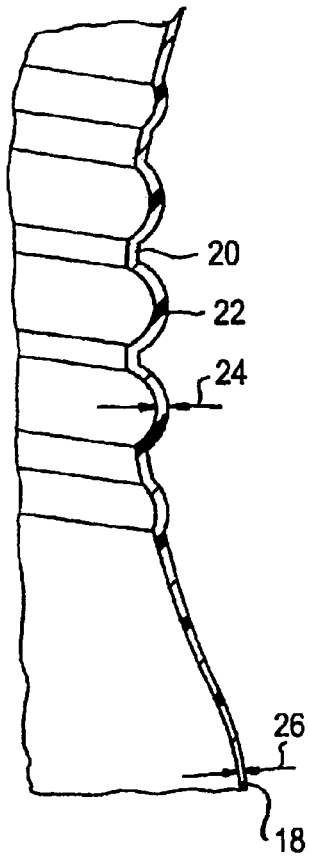
FIG. 5 is a fragmentary sectional view of the portion of the container within the area 5 in FIG. 2.
Figure 6:
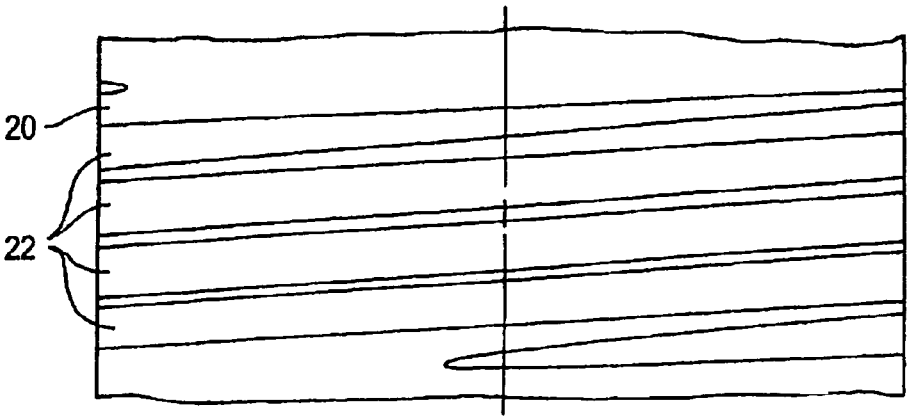
FIG. 6 is a developed view of the waist portion of the container in FIGS. 1 and 2.

At least one helical external rib 22 extends at least one full turn around container waist 20. In the preferred embodiment of the invention illustrated in the drawings, a single rib 22 extends 4.5 full turns around waist 20, and does not extend into shoulder 16 or base 18. Rib 22 is of externally rounded contour, and is blow-molded into the container body so that the waist 20, including the rib 22, is of generally uniform wall thickness, as best seen in FIG. 5. However, shoulder 16 and base 18 are of substantially greater outside diameter than waist 22, so that, from a preform or parison of uniform wall thickness, shoulder 16 and base 18 undergo greater hoop stretch than waist 20, and therefore are of lesser wall thickness. Waist 20, including rib 22, preferably has a thickness 24 (FIG. 5) in the range of 0.010 to 0.020 inch, whereas base 18 (and shoulder 16) can have a wall thickness 26 (FIG. 5) in the range of 0.003 to 0.004 inch. In one exemplary embodiment of the invention in a container 10 for holding sixteen ounces of liquid, waist 20 has an outside diameter of 1.864 inches, while base 18 has an outside diameter (B, FIG. 4) of 3.096 inches and shoulder 16 has an outside diameter (S, FIG. 4) of 3.080 inches. The container has an overall height of 8.195 inches. Thread-like rib 22 incorporated into the waist of the container gives the container mechanical stiffness for gripping and squeezing by a user, and yet allows angular movement of shoulder 16 with respect to base 18 for enhanced flexibility.

Container 10 can be of any suitable material and fabricated in any suitable blow molding operation. In one embodiment of the invention fabricated in an extrusion blow molding operation, the container is of PP construction. In another exemplary embodiment of the invention fabricated in a reheat blow molding operation, container 10 is of monolayer PET construction. Multilayer constructions can be fabricated in either an extrusion blow molding or a reheat blow molding operation. Although it is currently preferred for reasons of economy to fabricate the container of the present invention from a preform or parison having a body of uniform sidewall thickness, it is also within the scope of the present invention to vary the sidewall thickness of the preform or parison.

Figure 7:
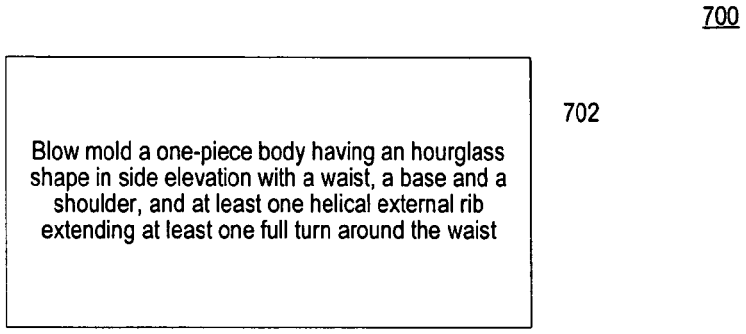
FIG. 7 depicts a flow chart of a method of manufacturing an exemplary embodiment of the present invention.

FIG. 7 depicts a flow chart 700 of a method of manufacturing an exemplary embodiment of the present invention. The method includes the step 702 of blow molding a one-piece body having an hourglass shape in side elevation with a waist, a base and a shoulder, and at least one helical external rib extending at least one full turn around said waist.

There have thus been disclosed a blow-molded plastic container and method of manufacture that fully satisfy all of the objects and aims previously set forth. The invention has been disclosed in conjunction with a presently preferred embodiment thereof, and a number of modifications and variations have been discussed. Other modifications and variations will readily suggest themselves to persons of ordinary skill in the art in view of the foregoing description. The invention is intended to embrace all such modifications and variations as fall within the spirit and broad scope of the appended claims.

The invention claimed is:

1. A plastic container that includes a body of one-piece integrally blow-molded construction having an hourglass shape in side elevation with a waist, a base and a shoulder, and at least one helical external rib extending at least one full turn around said waist, wherein said at least one helical external rib is confined to said waist, and does not extend into said base or said shoulder.

2. The container set forth in claim 1 wherein said at least one external helical rib has a rounded external surface contour.

3. The container set forth in claim 1 wherein said waist, including said at least one rib, has a greater wall thickness than said shoulder and said base.

4. The container set forth in claim 3 wherein said waist including said rib is of uniform wall thickness.

5. The container set forth in claim 1 wherein said waist, said base and said shoulder are circular in plan view.

6. The container set forth in claim 5 wherein said base has a greater diameter than said shoulder.

7. The container set forth in claim 5 wherein said rib extends 4.5 full turns around said waist.

8. A plastic container that includes a body of one-piece integrally blow-molded construction having an hourglass contour in side elevation with a waist, a base and a shoulder, and at least one external helical rib extending at least one full turn around said waist, wherein said at least one external helical rib is confined to said waist, and does not extend into said base or said shoulder, said waist including said rib being of uniform wall thickness and of greater wall thickness than said shoulder and said base, said waist, said shoulder and said base being circular in plan view.

9. The container set forth in claim 8 wherein said base has a greater diameter than said shoulder.

10. The container set forth in claim 8 wherein said at least one external rib has a rounded external surface contour.

11. A method of making a plastic container that includes the step of blow molding a one-piece body having an hourglass shape in side elevation with a waist, a base and a shoulder, and at least one helical external rib extending at least one full turn around said waist, wherein said at least one helical external rib is confined to said waist, and does not extend into said base or said shoulder.

12. The method set forth in claim 11 further comprising blow molding said one-piece body wherein said waist including said rib is of uniform wall thickness.

13. The method set forth in claim 12 further comprising blow molding said one-piece body wherein said at least one external helical rib has a rounded external surface contour.

14. The method set forth in claim 13 further comprising blow molding said one-piece body wherein said waist, said base and said shoulder are circular in plan view.

15. The method set forth in claim 14 further comprising blow molding said one-piece body wherein said base has a greater diameter than said shoulder.

16. The method set forth in claim 14 further comprising blow molding said one-piece body wherein said waist, including said at least one rib, has a greater wall thickness than said shoulder and said base.

17. The method set forth in claim 11 further comprising blow molding said one-piece body wherein said rib extends 4.5 full turns around said waist.

* * * * *